US010578368B2

(12) United States Patent
Kao et al.

(10) Patent No.: US 10,578,368 B2
(45) Date of Patent: Mar. 3, 2020

(54) TWO-PHASE FLUID HEAT TRANSFER STRUCTURE

(71) Applicant: ASIA VITAL COMPONENTS CO., LTD., New Taipei (TW)

(72) Inventors: Pai-Liang Kao, New Taipei (TW); Dan-Jun Chen, New Taipei (TW); Guo-Hui Li, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 52 days.

(21) Appl. No.: 15/874,892

(22) Filed: Jan. 19, 2018

(65) Prior Publication Data

US 2019/0226768 A1 Jul. 25, 2019

(51) Int. Cl.
*F28D 15/02* (2006.01)
*F28D 15/04* (2006.01)

(52) U.S. Cl.
CPC ..... *F28D 15/0266* (2013.01); *F28D 15/0275* (2013.01); *F28D 15/04* (2013.01)

(58) Field of Classification Search
CPC ..... F28D 15/02; F28D 15/0266; F28D 15/04; F28D 15/043; F28D 15/0275; F28D 2021/0028; F28D 2021/0031; F28D 2015/0216; H01L 23/473; H01L 23/427
USPC ..... 165/104.21, 104.26, 104.33, 104.22
See application file for complete search history.

(56) References Cited

U.S. PATENT DOCUMENTS 5,203,399 A * 4/1993 Koizumi ..... F25B 23/006 165/104.22
6,069,791 A * 5/2000 Goto ..... G06F 1/203 165/104.33
6,105,662 A * 8/2000 Suzuki ..... F28D 15/0241 165/104.33
6,269,865 B1 * 8/2001 Huang ..... F28D 15/0266 165/104.26
6,771,498 B2 * 8/2004 Wang ..... G06F 1/203 165/104.33
7,116,552 B2 * 10/2006 Wu ..... G06F 1/203 361/679.26
2003/0056936 A1 * 3/2003 Lindemuth ..... F25B 23/006 165/45
2003/0151897 A1 * 8/2003 Lai ..... H01L 23/427 361/700

(Continued)

*Primary Examiner* — Jianying C Atkisson
*Assistant Examiner* — Jose O Class-Quinones
(74) *Attorney, Agent, or Firm* — Jackson IPG PLLC; Demian K Jackson

(57) ABSTRACT

A two-phase fluid heat transfer structure includes: at least one evaporator having an evaporation chamber, which containing a first working medium; at least one evaporator tube body having a first end and a second end, which communicating with the at least one evaporator to form a loop of the first working medium, the at least one evaporator tube body further having a condensation section between the first and second ends; at least one heat sink; at least one heat sink tube body having a heat absorption section, which containing a second working medium, the at least one heat sink tube body being connected to the at least one heat sink; and at least one heat exchanger having a first face and a second face for the condensation section of the evaporator tube body and the heat absorption section of the heat sink tube body to attach to.

19 Claims, 14 Drawing Sheets

(56) References Cited

U.S. PATENT DOCUMENTS

| | | | | |
|---|---|---|---|---|
| 2005/0081534 | A1* | 4/2005 | Suzuki | F28D 1/05366 62/50.2 |
| 2006/0144567 | A1* | 7/2006 | Zhu | F28D 15/0275 165/104.29 |
| 2006/0173344 | A1* | 8/2006 | Marian | A61B 8/00 600/459 |
| 2007/0102146 | A1* | 5/2007 | Scott | F28D 15/0266 165/177 |
| 2007/0187072 | A1* | 8/2007 | Chin | F28D 15/043 165/104.26 |
| 2008/0164010 | A1* | 7/2008 | Kang | F28D 15/0266 165/104.26 |
| 2009/0310307 | A1* | 12/2009 | Lin | G06F 1/203 361/700 |
| 2011/0198057 | A1* | 8/2011 | Lange | F28D 15/0233 165/104.26 |
| 2013/0186602 | A1* | 7/2013 | Figus | F28D 15/0266 165/104.26 |
| 2016/0131438 | A1* | 5/2016 | De Troz | F28D 15/0266 165/104.26 |

* cited by examiner

TWO-PHASE FLUID HEAT TRANSFER STRUCTURE

BACKGROUND OF THE INVENTION

1. Field of the Invention

The present invention relates generally to a heat dissipation field, and more particularly to a two-phase fluid heat transfer structure, in which the heat exchange area is minified and the heat transfer path is shortened to enhance the heat exchange efficiency.

2. Description of the Related Art

A fan and radiating fins are often applied to an electronic product to dissipate heat. However, along with the development of electronic technique, the power of the electronic product has become higher and higher to increase the heat flux. Therefore, two-phase fluid heat transfer technique has been applied to those products or environments with high heat flux to dissipate the heat. According to the theory of phase change, the heat flux can reach over 50W/cm$^2$ without extra electrical power. Therefore, the two-phase fluid heat transfer technique has the advantages of heat transfer and energy saving.

The current two-phase fluid heat transfer techniques include loop heat pipe (LHP), capillary porous loop (CPL), two-phase loop thermosyphon (LTS), etc. The device of the two-phase fluid heat transfer technique generally includes an evaporator and a heat sink connected with each other via a vapor tube and a liquid tube to form a closed loop. Through the vapor tube, the heat is transferred from the evaporator to the remote end heat sink so as to dissipate the heat.

However, the heat sink of the current two-phase fluid heat transfer technique is cooled by a fan. The fan for cooling the heat sink necessitates a larger heat exchange area so that a larger internal space of the system will be occupied. Also, the heat transfer path of the conventional vapor tube and liquid tube is longer so that the working medium in the vapor tube and liquid tube can hardly quickly flow back. This leads to poor heat exchange efficiency.

It is therefore tried by the applicant to provide a two-phase fluid heat transfer structure, which can fully utilize the internal space of the system to satisfy the heat exchange requirement of the heat sink and surpasses the heat exchange efficiency of the fan.

SUMMARY OF THE INVENTION

It is therefore a primary object of the present invention to provide a two-phase fluid heat transfer structure, in which the heat exchange area is minified and the heat transfer path of the vapor tube and the condensation tube is shortened.

It is a further object of the present invention to provide the above two-phase fluid heat transfer structure, which can enhance the heat exchange efficiency.

To achieve the above and other objects, the two-phase fluid heat transfer structure of the present invention includes: at least one evaporator having an evaporation chamber inside, a first working medium being contained in the evaporation chamber; at least one evaporator tube body having a first end and a second end, the first and second ends communicating with the at least one evaporator to form a loop of the first working medium, the at least one evaporator tube body further having a condensation section between the first and second ends; at least one heat sink; at least one heat sink tube body having a heat absorption section, the at least one heat sink tube body being connected to the at least one heat sink, a second working medium being contained in the at least one heat sink tube body; and at least one heat exchanger having a first face and a second face for the condensation section of the evaporator tube body and the heat absorption section of the heat sink tube body to attach to.

According to the design of the present invention, a heat exchanger is disposed on the condensation section of the evaporator tube body or multiple heat exchangers are stacked and assembled. In addition, through the heat sink tube body, the heat is quickly transferred to the heat sink to dissipate the heat. In this case, the heat exchange area is minified and the heat transfer path is shortened to enhance the heat exchange efficiency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
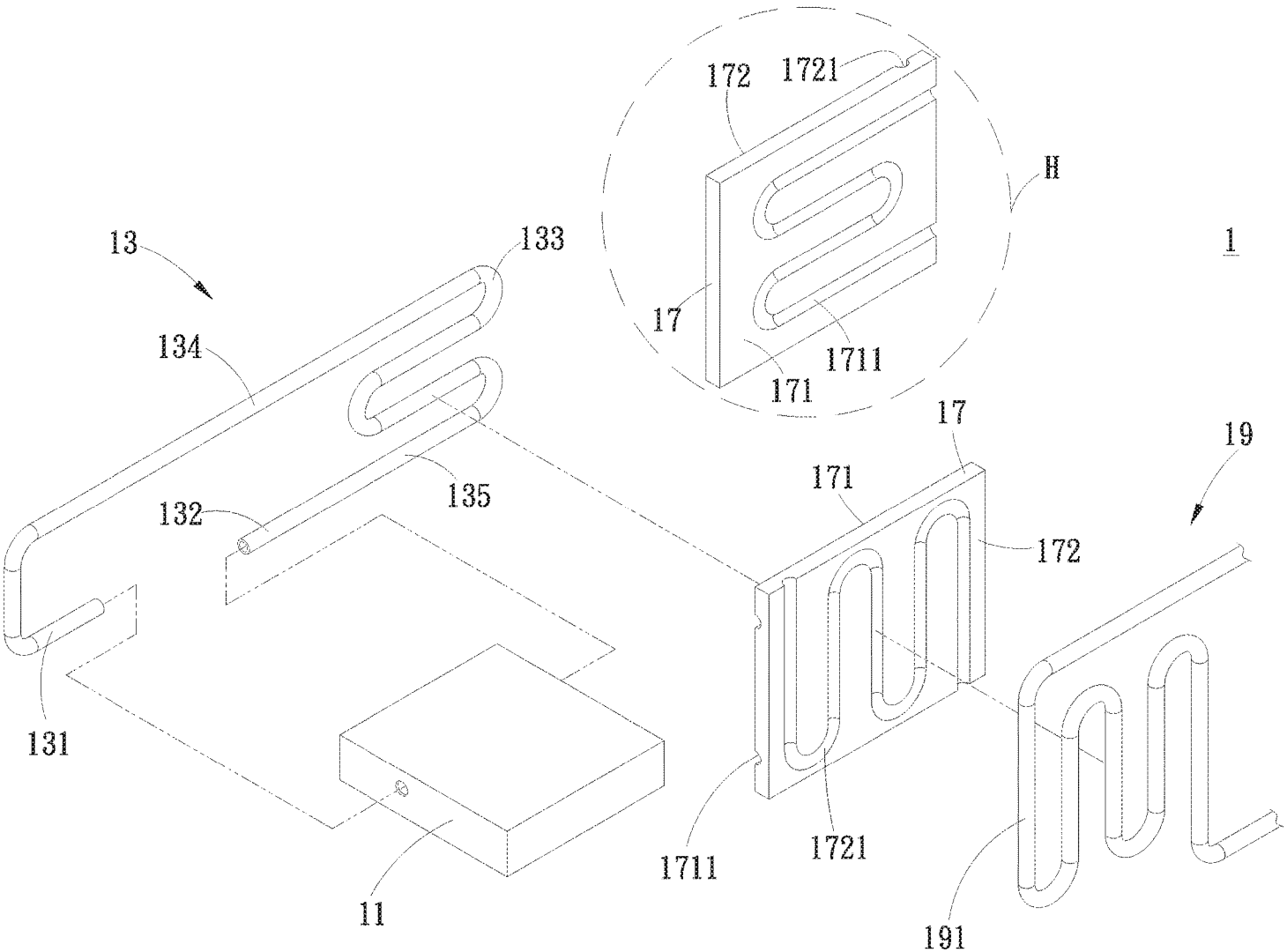
FIG. 1A is a perspective exploded view of a first embodiment of the two-phase fluid heat transfer structure of the present invention.
Figure 1B:
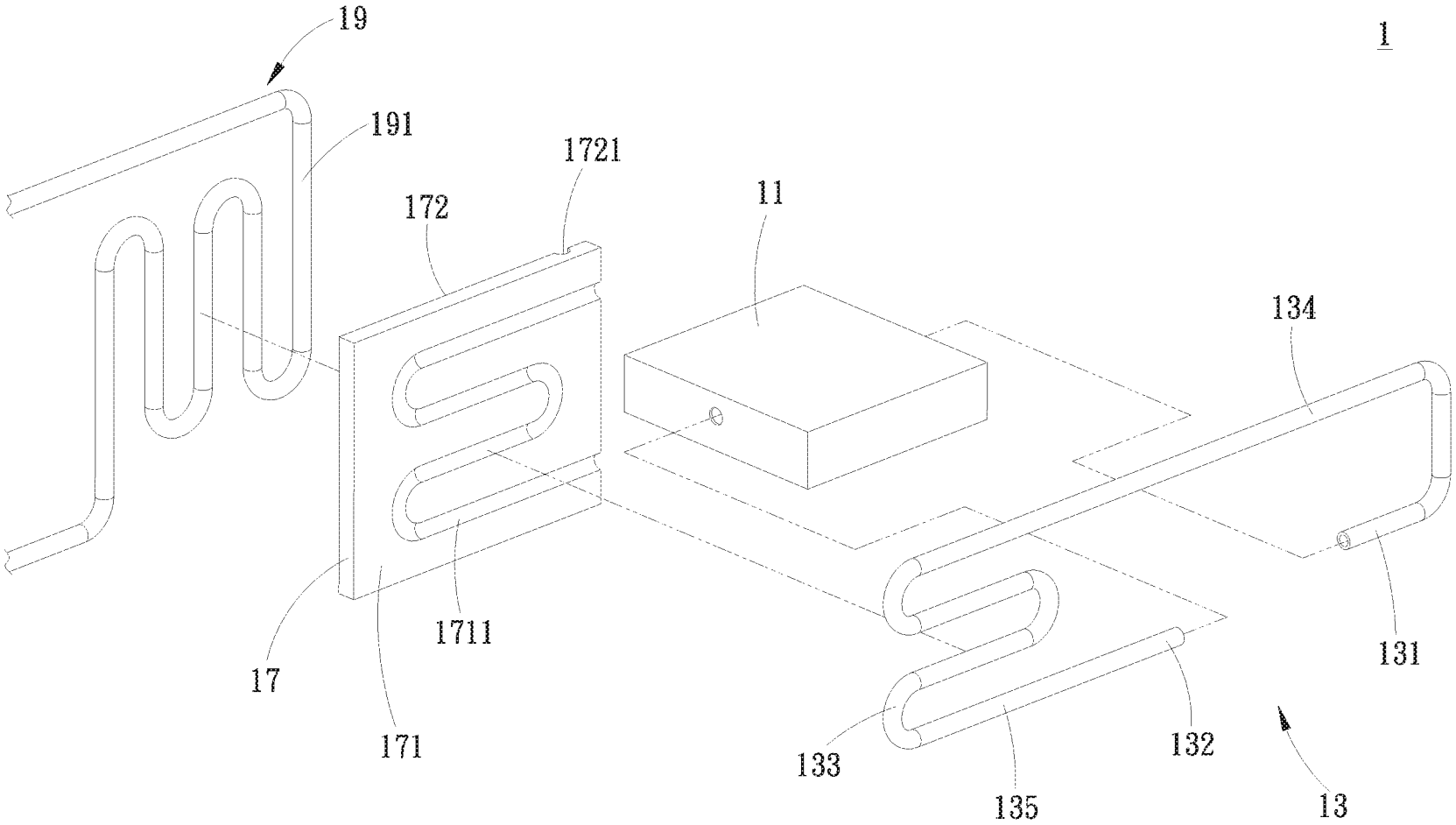
FIG. 1B is a perspective exploded view of the first embodiment of the two-phase fluid heat transfer structure of the present invention, seen from another angle.
Figure 1C:
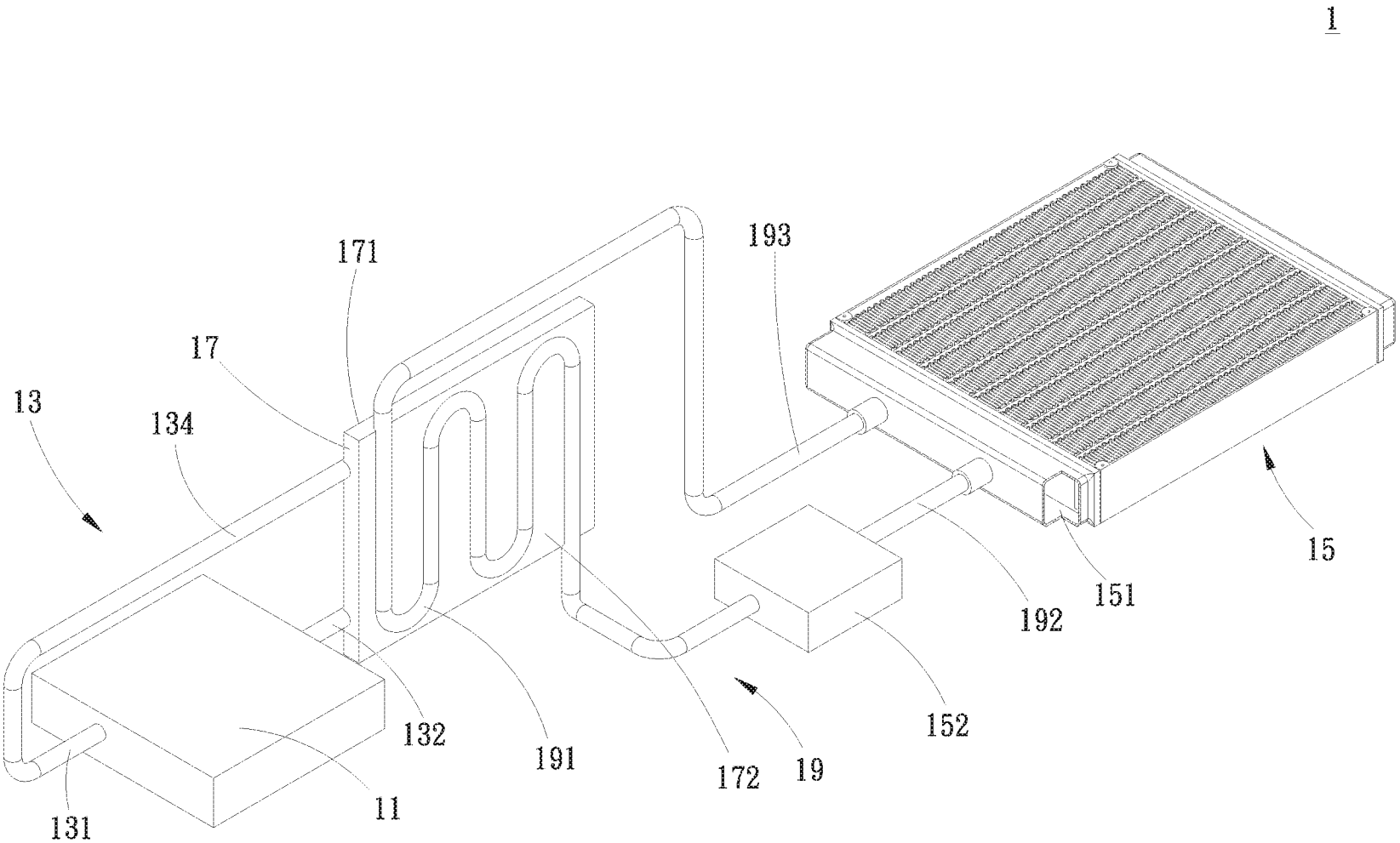
FIG. 1C is a perspective assembled view of the first embodiment of the two-phase fluid heat transfer structure of the present invention.
Figure 1D:
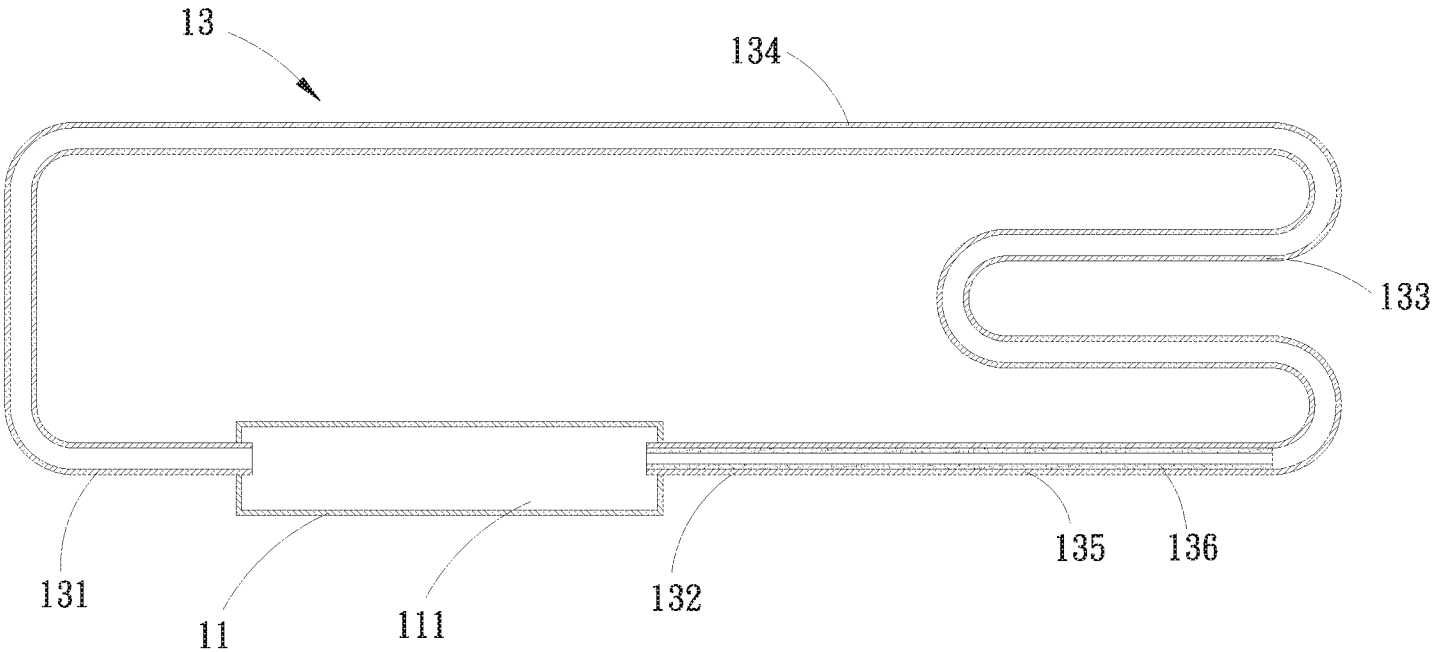
FIG. 1D is a sectional view of the evaporator and the evaporator tube body of the first embodiment of the two-phase fluid heat transfer structure of the present invention.

Please refer to FIGS. 1A, 1B, 1C and 1D. FIG. 1A is a perspective exploded view of a first embodiment of the two-phase fluid heat transfer structure of the present invention. FIG. 1B is a perspective exploded view of the first embodiment of the two-phase fluid heat transfer structure of the present invention, seen from another angle. FIG. 1C is a perspective assembled view of the first embodiment of the two-phase fluid heat transfer structure of the present invention. FIG. 1D is a sectional view of the evaporator and the evaporator tube body of the first embodiment of the two-phase fluid heat transfer structure of the present invention. According to the first embodiment, the two-phase fluid heat transfer structure 1 of the present invention includes at least one evaporator, at least one evaporator tube body, at least one heat sink, at least one heat exchanger and at least one heat exchanger tube body. In this embodiment, there are, but not limited to, one evaporator 11, one evaporator tube body 13, one heat sink 15, one heat exchanger 17 and one heat exchanger tube body 19. In practice, some modifications of this embodiment can be made as described hereinafter.

The evaporator 11 has an evaporation chamber 111 inside. A first working medium is contained in the evaporation chamber 111. The first working medium is a liquid with high specific heat coefficient. The evaporator 11 is attached to a heat source (not shown) to absorb heat from the heat source. In this embodiment, the evaporator 11 is, but not limited to, a rectangular plate body. In a modified embodiment, the evaporator 11 can be alternatively a tubular evaporator with a diameter larger than that of the evaporator tube body 13. The shape or configuration of the evaporator 11 of the present invention is not limited.

The evaporator tube body 13 has a first end 131 and a second end 132 respectively positioned at two opposite ends of the evaporator tube body 13. The first and second ends 131, 132 communicate with the evaporation chamber 111 to form a loop of the first working medium. A condensation section 133 is positioned between the first and second ends 131, 132. The evaporator tube body 13 further has a vapor section 134 and a liquid section 135. The vapor section 134 is adjacent to the first end 131. The liquid section 135 is adjacent to the second end 132. The condensation section 133 is connected between the vapor section 134 and the liquid section 135. In this embodiment, a capillary structure 136 is, but not limited to, disposed in the liquid section 135. In a modified embodiment, the interior of the liquid section 135 can be alternatively free from the capillary structure 136. In this embodiment, the evaporator tube body 13 is, but not limited to, a circular tube. In a modified embodiment, the evaporator tube body 13 can be alternatively a flat tube.

The heat sink 15 has a condensation chamber 151 and a pump 152. In this embodiment, the heat sink 15 is a water-cooling radiator as shown in FIG. 1C in a partially sectional state.

The heat sink tube body 19 has a heat absorption section 191, a third end 192 and a fourth end 193. The third and fourth ends 192, 193 are respectively disposed at two opposite ends of the heat sink tube body 19. The heat absorption section 191 is connected between the third and fourth ends 192, 193. The heat sink tube body 19 is connected to the heat sink 15. A second working medium is contained in the heat sink tube body 19. The third and fourth ends 192, 193 communicate with the condensation chamber 151 and the pump 152 to form a loop of the second working medium. The second working medium is a liquid with high specific heat coefficient. In this embodiment, the heat sink tube body 19 is, but not limited to, a water-cooling tube and the pump 152 is disposed in adjacency to the third end 192 of the heat sink tube body 19. In a modified embodiment, the pump 152 can be alternatively disposed in adjacency to the fourth end 193 of the heat sink tube body 19. In this embodiment, the heat sink tube body 19 is, but not limited to, a circular tube. In a modified embodiment, the heat sink tube body 19 can be alternatively a flat tube.

The heat exchanger 17 has a first face 171 and a second face 172 respectively disposed on two opposite faces of the heat exchanger 17 for the condensation section 133 of the evaporator tube body 13 and the heat absorption section 191 of the heat sink tube body 19 to attach to. The condensation section 133 of the evaporator tube body 13 is selectively attached to the first face 171 or the second face 172. The heat absorption section 191 of the heat sink tube body 19 is selectively attached to the first face 171 or the second face 172. In this embodiment, the condensation section 133 of the evaporator tube body 13 is, but not limited to, attached to the first face 171 of the heat exchanger 17 and the heat absorption section 191 of the heat sink tube body 19 is, but not limited to, attached to the second face 172 of the heat exchanger 17. Alternatively, the condensation section 133 of the evaporator tube body 13 can be attached to the second face 172 and the heat absorption section 191 of the heat sink tube body 19 can be attached to the first face 171. Still alternatively, the evaporator tube body 13 and the heat sink tube body 19 can be both attached to the first face 171 or the second face 172. In order to facilitate the reference of the drawings, in FIG. 1A, the heat exchanger 17 is denoted with H to show the heat exchanger 17 in another angle.

In this embodiment, the heat exchanger 17 has a first recess 1711 corresponding to the evaporator tube body 13 and a second recess 1721 corresponding to the heat sink tube body 19. The condensation section 133 of the evaporator tube body 13 is, but not limited to, inlaid in the first recess 1711 and the heat absorption section 191 of the heat sink tube body 19 is, but not limited to, inlaid in the second recess 1721. In a modified embodiment, the heat exchanger 17 has a plane surface and the condensation section 133 of the evaporator tube body 13 and the heat absorption section 191 of the heat sink tube body 19 are attached to the plane surface of the heat exchanger 17. In another modified embodiment, the condensation section 133 of the evaporator tube body 13 is inlaid in the first recess 1711 of the heat exchanger 17 in flush with the outer surface of the heat exchanger 17 and the heat absorption section 191 of the heat sink tube body 19 is inlaid in the second recess 1721 of the heat exchanger 17 in flush with the outer surface of the heat exchanger 17. In this embodiment, the heat exchanger 17 is selected from a group consisting of a heat conduction plate, a flat-plate heat pipe, a vapor chamber and a heat conduction base seat.

In a preferred embodiment, the first working medium in the evaporation chamber 111 is heated to the boiling point and evaporated into a vapor-phase first working medium. The vapor-phase first working medium passes through the first end 131 into the vapor section 134. Then the vapor-phase first working medium flows through the vapor section 134 to the condensation section 133. The condensation section 133 absorbs the heat of the vapor-phase first working medium and heat-exchanges with the heat exchanger 171. The vapor-phase first working medium in the condensation section 133 is condensed into a liquid-phase first working medium. The liquid-phase first working medium is absorbed by the capillary structure 136 of the liquid section 135 to flow through the second end 132 back into the evaporation chamber 111 of the evaporator 11. In a modified embodiment, the liquid section 135 is free from the capillary structure 136 and the liquid-phase first working medium is pushed by gas pressure to flow through the second end 132 back into the evaporation chamber 111 of the evaporator 11.

The heat exchanger 17 absorbs the heat of the condensation section 133 of the evaporator tube body 13 and the heat absorption section 191 of the heat sink tube body 19 absorbs the heat of the heat exchanger 17. The second working medium is driven by the pump 152 to flow from the condensation chamber 151 of the heat sink 15 through the third end 192 of the heat exchanger tube body 19 to the heat absorption section 191. The second working medium absorbs the heat of the heat absorption section 191 and flows from the fourth end 193 back into the condensation chamber 151. The heat sink 15 absorbs the heat of the second working medium to dissipate the heat by way of radiation.

In a modified embodiment, the heat sink 15 can be alternatively a radiating fin assembly (not shown) and the heat sink tube body 19 can be alternatively a heat pipe (not shown). The heat sink tube body 19 is connected to the heat sink 15. The heat absorption section 191 of the heat sink tube body 19 is attached to the second face 172 of the heat exchanger 17. The heat sink 15 is disposed at one end of the heat sink tube body 19 opposite to the heat absorption section 191. Accordingly, the heat absorption section 191 serves as the evaporation section of the heat pipe and one end of the heat sink tube body 19 opposite to the heat absorption section 191 serves as the condensation section of the heat pipe. In this case, the working medium is changed between the vapor phase and liquid phase. The vapor-phase working medium flows from the evaporation section to the condensation section, while the liquid-phase working medium flows from the condensation section to the evaporation section by way of convection. Accordingly, the working medium is circulated to achieve the objects of heat transfer and heat dissipation.

According to the design of the present invention, the heat of the evaporator 11 is collectively transferred to the heat exchanger 17. Then the heat of the heat exchanger 17 is transferred through the heat sink tube body 19 to the heat sink 15 to dissipate the heat. Therefore, the heat exchange area can be minified. Also, the heat transfer path can be shortened, whereby the first and second working media can quickly flow back to enhance the heat exchange efficiency.

Figure 2A:
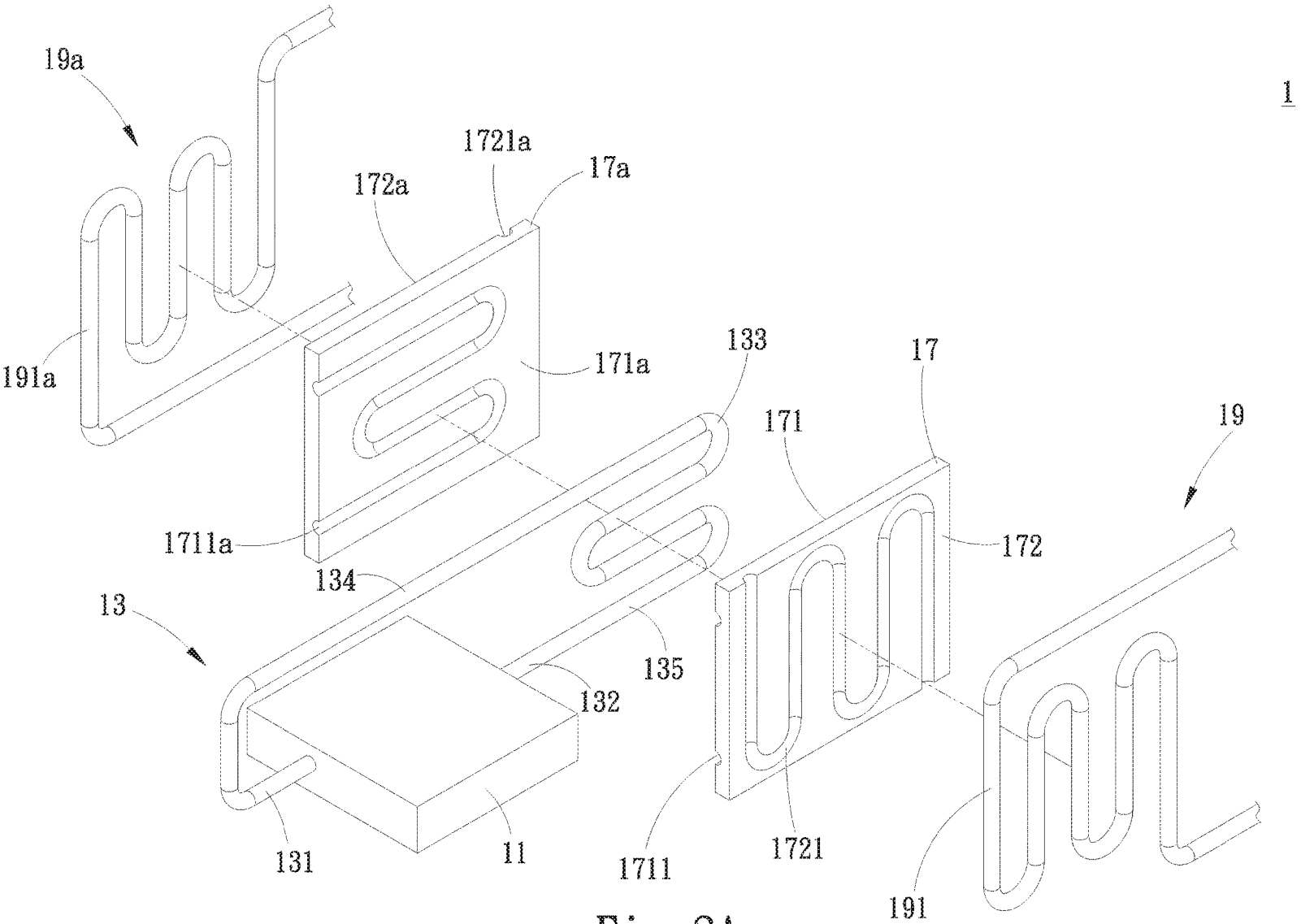
FIG. 2A is a perspective exploded view of a second embodiment of the two-phase fluid heat transfer structure of the present invention.
Figure 2B:
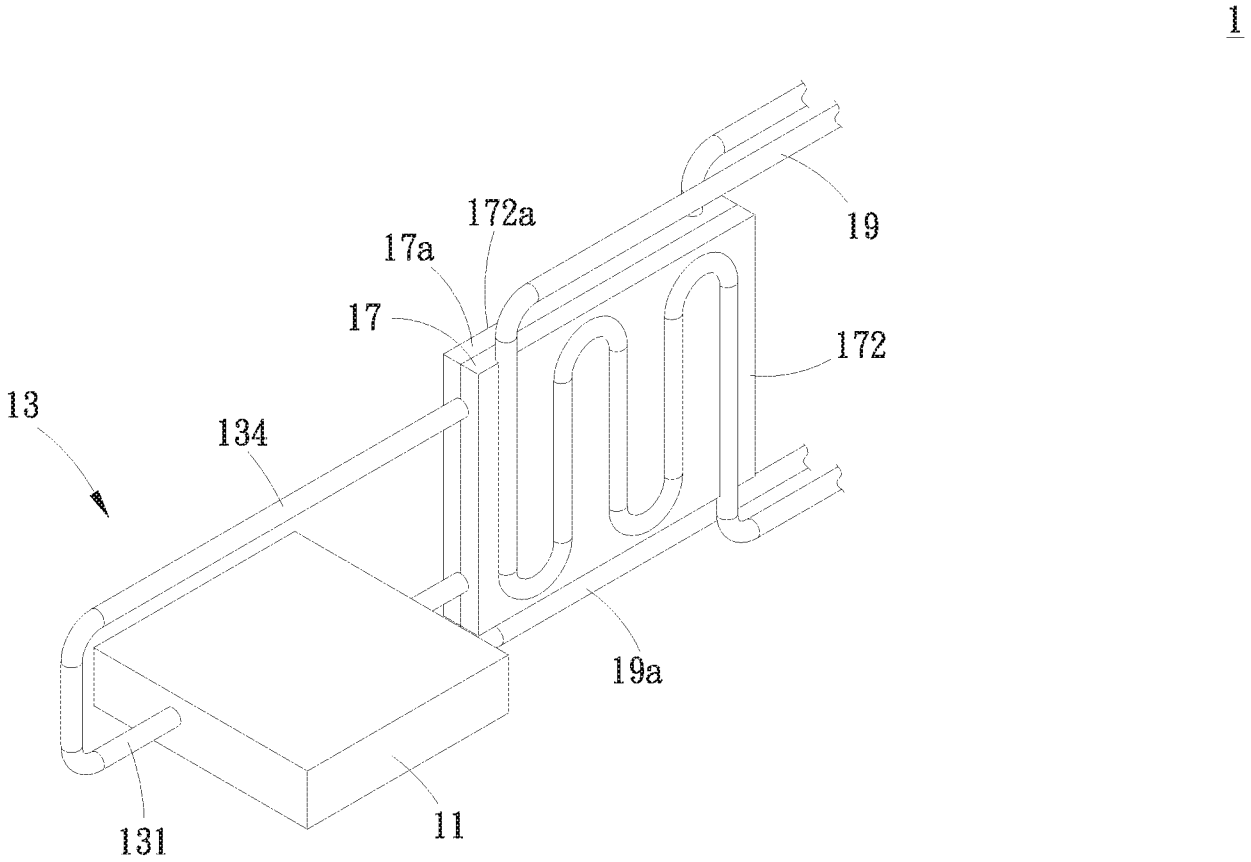
FIG. 2B is a perspective assembled view of the second embodiment of the two-phase fluid heat transfer structure of the present invention.

Please now refer to FIGS. 2A and 2B. FIG. 2A is a perspective exploded view of a second embodiment of the two-phase fluid heat transfer structure of the present invention. FIG. 2B is a perspective assembled view of the second embodiment of the two-phase fluid heat transfer structure of the present invention. Also referring to FIGS. 1A, 1B, 1C and 1D, the second embodiment is partially identical to the first embodiment in structure and function and thus will not be redundantly described hereinafter. The second embodiment is different from the first embodiment in that the at least one heat exchanger includes a first heat exchanger 17 and a second heat exchanger 17*a*. The at least one heat sink tube body includes a first heat sink tube body 19 and a second heat sink tube body 19*a*. The at least one heat sink includes a first heat sink 15 and a second heat sink (not shown). The first heat sink tube body 19 is connected to the first heat sink 15. The second heat sink tube body 19*a* is connected to the second heat sink. The structure and assembling relationship of the second heat sink tube body 19*a* and the second heat sink are identical to the structure and assembling relationship of the heat sink tube body 19 and the heat sink 15 as shown in FIG. 1C.

In this embodiment, the condensation section 133 of the first evaporator tube body 13 is, but not limited to, attached to the first face 171 of the first heat exchanger 17 and the first face 171*a* of the second heat exchanger 17*a*. The heat absorption section 191 of the first heat sink tube body 19 is, but not limited to, attached to the second face 172 of the first heat exchanger 17. The heat absorption section 191*a* of the second heat sink tube body 19*a* is, but not limited to, attached to the second face 172*a* of the second heat exchanger 17*a*. Alternatively, the heat absorption sections 191, 191*a* of the first and second heat sink tube bodies 19, 19*a* are respectively attached to the first faces 171, 171*a* of the first and second heat exchangers 17, 17*a*. The condensation section 133 of the evaporator tube body 13 is inlaid in the first recess 1711 of the first heat exchanger 17 and the first recess 1711*a* of the second heat exchanger 17*a*. The heat absorption section 191 of the first heat sink tube body 19 is inlaid in the second recess 1721 of the first heat exchanger 17. The heat absorption section 191*a* of the second heat sink tube body 19*a* is inlaid in the second recess 1721*a* of the second heat exchanger 17*a*.

Accordingly, the first face 171 of the first heat exchanger 17 and the first face 171*a* of the second heat exchanger 17*a* are correspondingly attached to each other.

According to the above arrangement, the condensation section 133 of the evaporator tube body 13 can heat-exchange with the first and second heat exchangers 17, 17*a* at the same time. The first and second heat exchangers 17, 17*a* absorb the heat of the condensation section 133. The heat absorption sections 191, 191*a* of the first and second heat sink tube bodies 19, 19*a* respectively absorb the heat of the first and second heat exchangers 17, 17*a*. The first heat exchanger 17 also heat-exchanges with the second heat exchanger 17*a*. The second working medium carries away the heat and flows back to the first and second heat sinks. Therefore, the heat exchange area is minified and the heat transfer path is shortened to enhance the heat exchange efficiency.

Figure 3A:
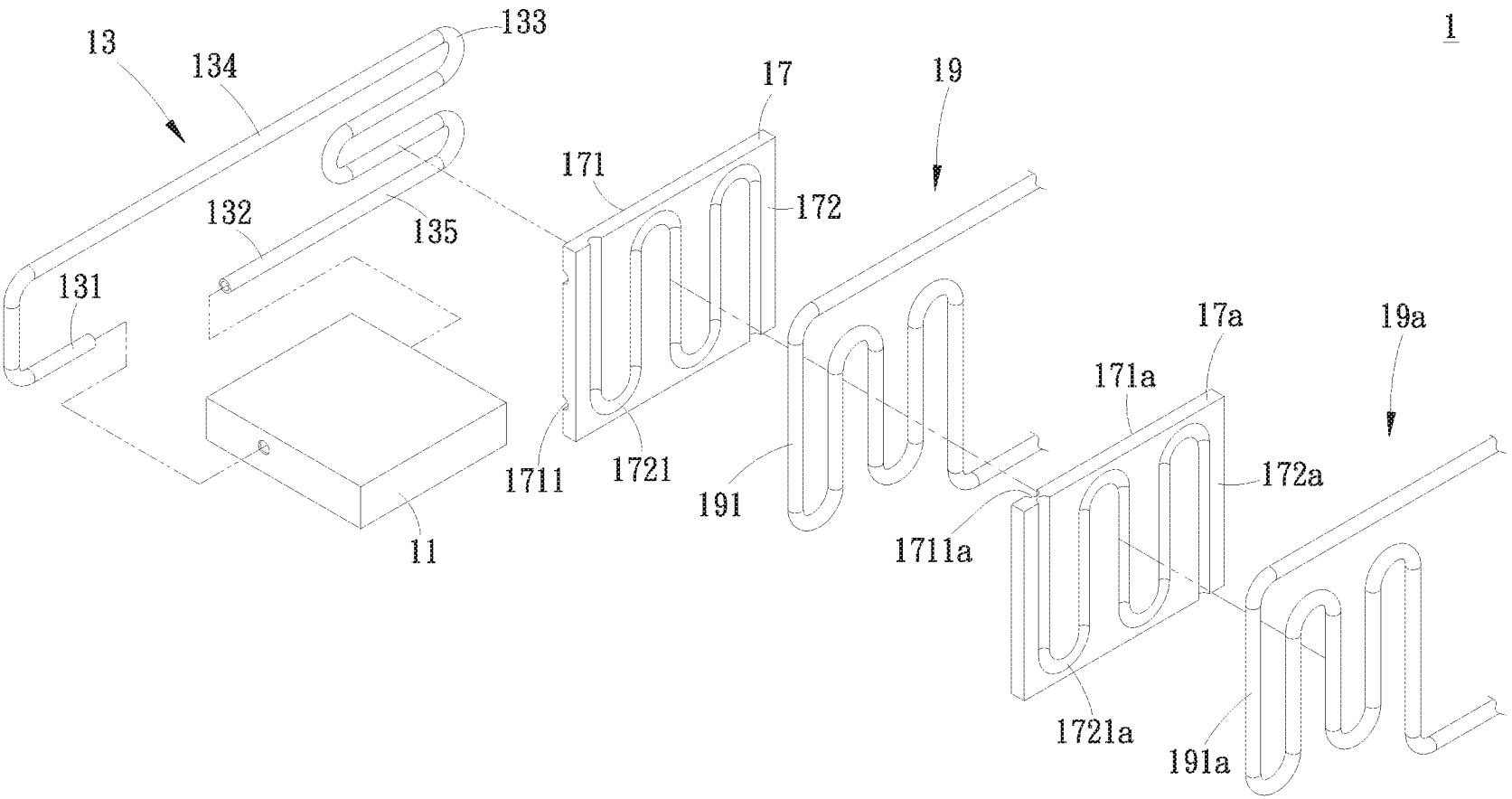
FIG. 3A is a perspective exploded view of a third embodiment of the two-phase fluid heat transfer structure of the present invention.
Figure 3B:
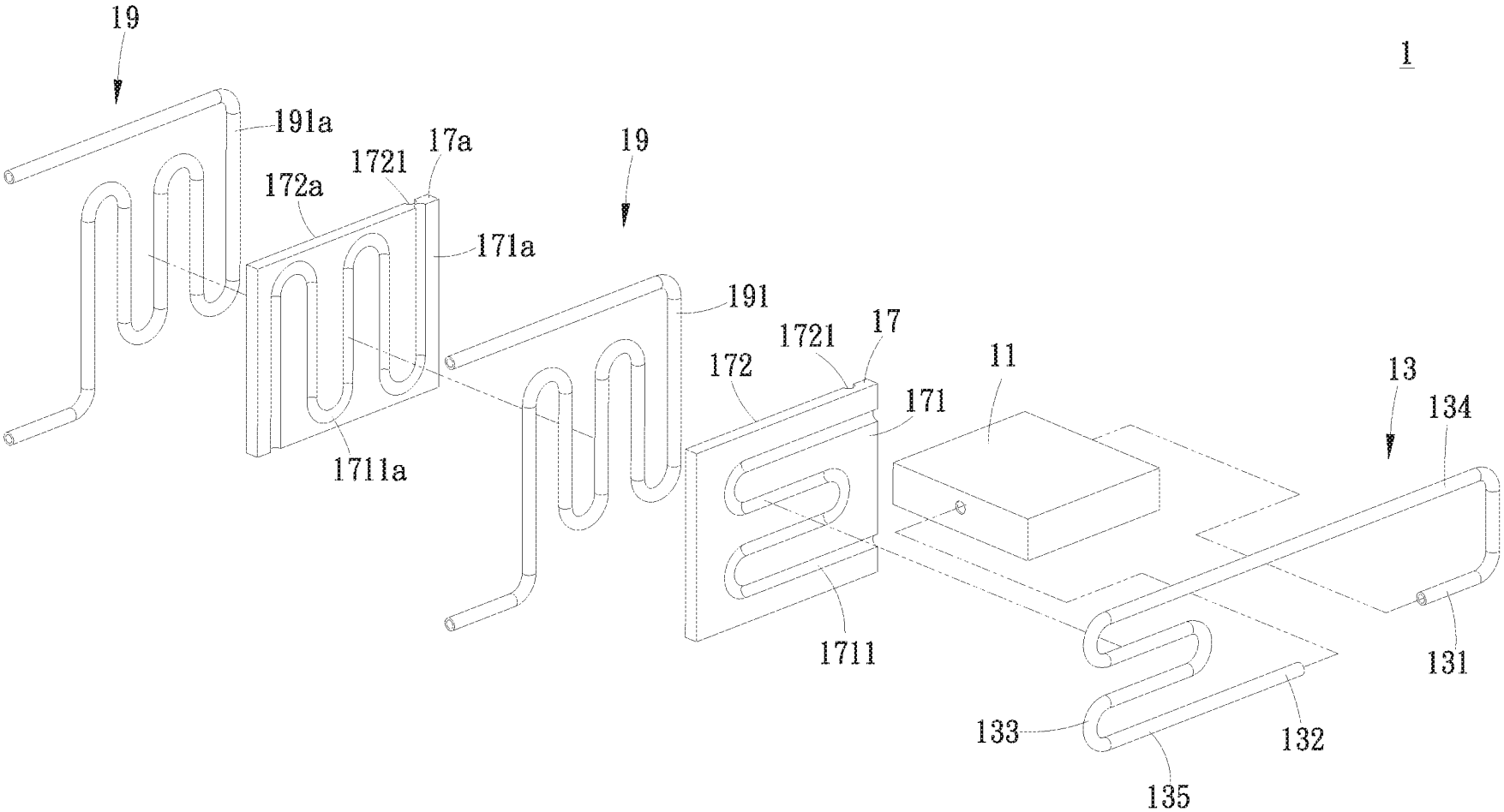
FIG. 3B is a perspective exploded view of the third embodiment of the two-phase fluid heat transfer structure of the present invention, seen from another angle.

Please now refer to FIGS. 3A and 3B. FIG. 3A is a perspective exploded view of a third embodiment of the two-phase fluid heat transfer structure of the present invention. FIG. 3B is a perspective exploded view of the third embodiment of the two-phase fluid heat transfer structure of the present invention, seen from another angle. Also referring to FIGS. 2A and 2B, the third embodiment is partially identical to the second embodiment in structure and function and thus will not be redundantly described hereinafter. The third embodiment is different from the second embodiment in that the condensation section 133 of the first evaporator tube body 13 is, but not limited to, attached to the first face 171 of the first heat exchanger 17. The heat absorption section 191 of the first heat sink tube body 19 is, but not limited to, attached to the second face 172 of the first heat exchanger 17 and the first face 171*a* of the second heat exchanger 17*a*. The heat absorption section 191*a* of the second heat sink tube body 19*a* is, but not limited to, attached to the second face 172*a* of the second heat exchanger 17*a*. Alternatively, the heat absorption section 191*a* of the second heat sink tube body 19*a* can be attached to the first face 171*a* of the second heat exchanger 17*a*.

Accordingly, the second face 172 of the first heat exchanger 17 and the first face 171*a* of the second heat exchanger 17*a* are correspondingly attached to each other.

According to the above arrangement, the condensation section 133 of the evaporator tube body 13 heat-exchanges with the first heat exchanger 17. The first heat exchanger 17 absorbs the heat of the condensation section 133. The heat absorption section 191 of the first heat sink tube body 19 absorbs the heat of the first heat exchanger 17. The second working medium carries away the heat and flows back to the first heat sink 15. Also, the heat absorption section 191 of the first heat sink tube body 19 heat-exchanges with the second heat exchanger 17*a* and the first heat exchanger 17 heat-exchanges with the second heat exchanger 17*a*. The second heat exchanger 17*a* absorbs the heat of the heat absorption section 191 of the first heat sink tube body 19 and the heat of the first heat exchanger 17. The heat absorption section 191*a* of the second heat sink tube body 19*a* absorbs the heat of the second heat exchanger 17*a*. The second working medium carries away the heat and flows back to the second heat sink. Therefore, the heat exchange area is minified and the heat transfer path is shortened to enhance the heat exchange efficiency.

Figure 4A:
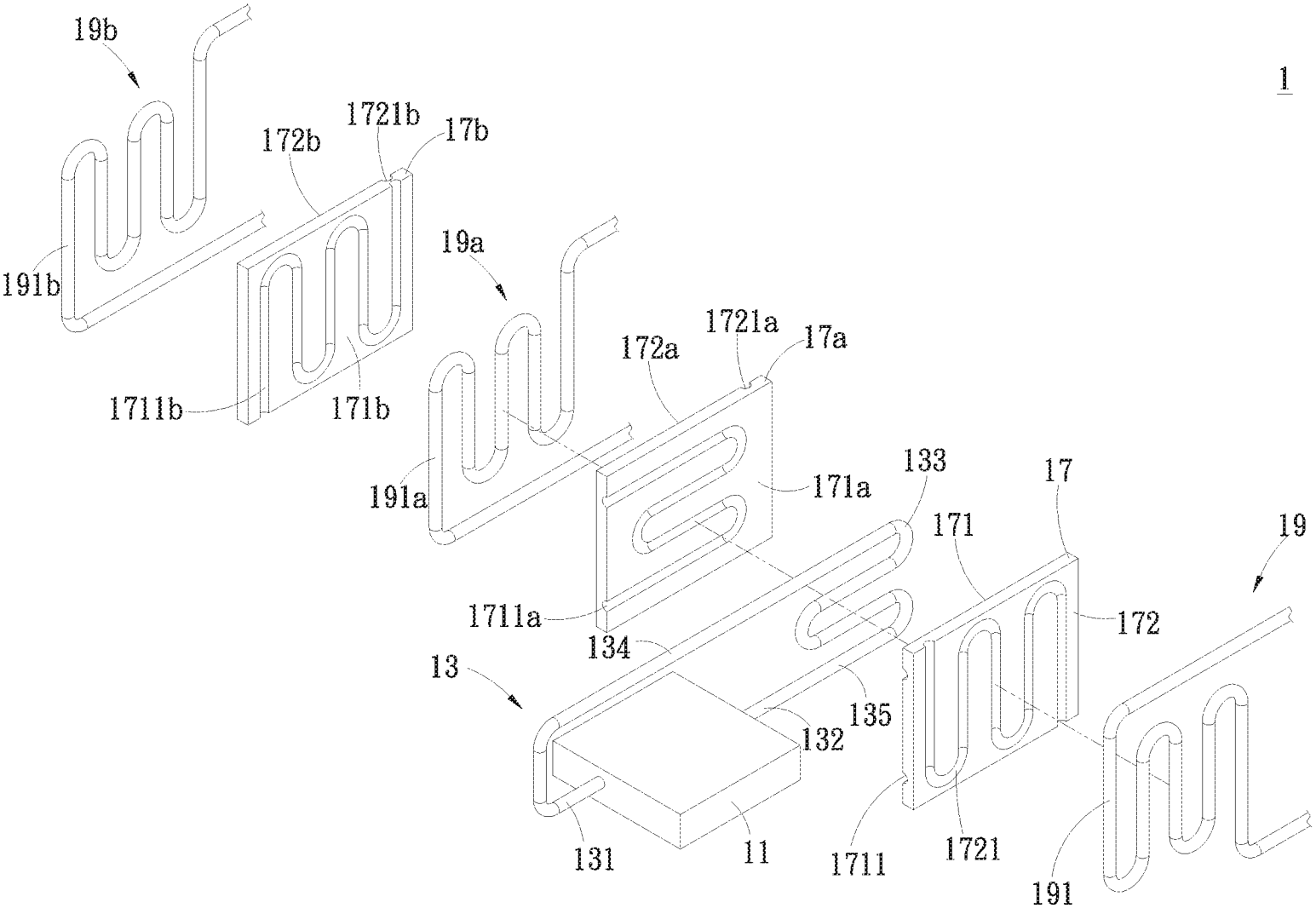
FIG. 4A is a perspective exploded view of a fourth embodiment of the two-phase fluid heat transfer structure of the present invention.
Figure 4B:
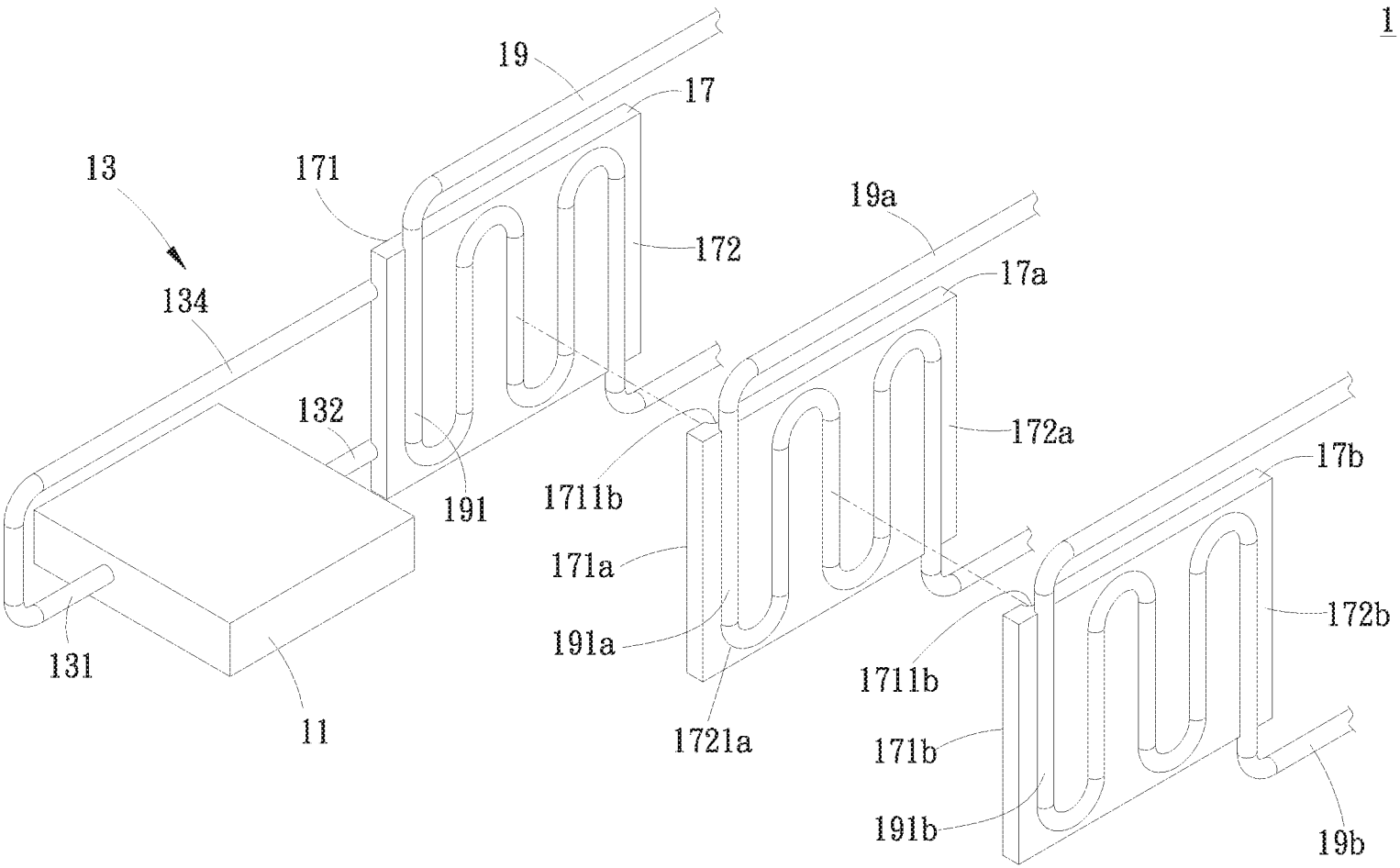
FIG. 4B is a perspective assembled view of the fourth embodiment of the two-phase fluid heat transfer structure of the present invention.

Please now refer to FIGS. 4A and 4B. FIG. 4A is a perspective exploded view of a fourth embodiment of the two-phase fluid heat transfer structure of the present invention. FIG. 4B is a perspective assembled view of the fourth embodiment of the two-phase fluid heat transfer structure of the present invention. Also referring to FIGS. 2A, 2B, 3A and 3B, the fourth embodiment is partially identical to the third embodiment in structure and function and thus will not be redundantly described hereinafter. The fourth embodiment is different from the third embodiment in that the at least one heat exchanger further includes a third heat exchanger 17*b*. The at least one heat sink tube body further includes a third heat sink tube body 19*b*. The at least one heat sink further includes a third heat sink (not shown). The third heat sink tube body 19*b* is connected to the third heat sink. The structure and assembling relationship of the third heat sink tube body 19*b* and the third heat sink are identical to the structure and assembling relationship of the heat sink tube body 19 and the heat sink 15 as shown in FIG. 1C.

In this embodiment, the heat absorption section 191*a* of the second heat sink tube body 19*a* is, but not limited to, attached to the second face 172*a* of the second heat exchanger 17*a* and the first face 171*b* of the third heat exchanger 17*b*. The heat absorption section 191*b* of the third heat sink tube body 19*b* is, but not limited to, attached to the second face 172*b* of the third heat exchanger 17*b*. Alternatively, the heat absorption section 191*b* of the third heat sink tube body 19*b* can be attached to the first face 171*b* of the third heat exchanger 17*b*. The heat absorption section 191*a* of the second heat sink tube body 19*a* is inlaid in the second recess 1721*a* of the second heat exchanger 17*a* and the first recess 1711*b* of the third heat exchanger 17*b*. The heat absorption section 191*b* of the third heat sink tube body 19*b* is inlaid in the second recess 1721*b* of the third heat exchanger 17*b*.

Accordingly, the second face 172*a* of the second heat exchanger 17*a* and the first face 171*b* of the third heat exchanger 17*b* are correspondingly attached to each other.

According to the above arrangement, the heat absorption section 191*a* of the second heat sink tube body 19*a* heat-exchanges with the third heat exchanger 17*b* and the second heat exchanger 17*a* also heat-exchanges with the third heat exchanger 17*b*. The third heat exchanger 17*b* absorbs the heat of the heat absorption section 191*a* of the second heat sink tube body 19*a* and the heat of the second heat exchanger 17*a*. The heat absorption section 191*b* of the third heat sink tube body 19*b* absorbs the heat of the third heat exchanger 17*b*. The second working medium carries away the heat and flows back to the third heat sink. Therefore, the heat exchange area is minified and the heat transfer path is shortened to enhance the heat exchange efficiency.

Figure 5A:
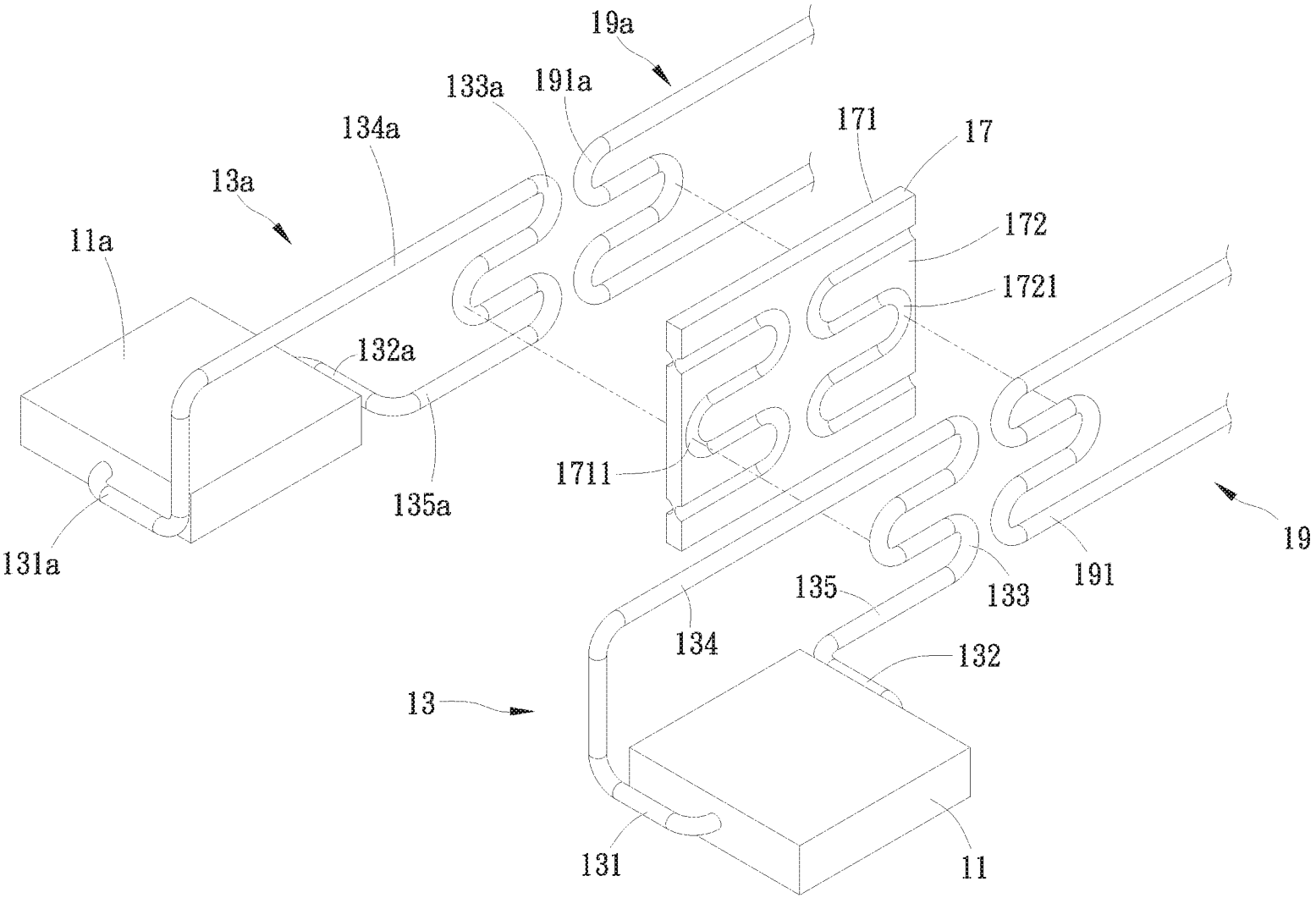
FIG. 5A is a perspective exploded view of a fifth embodiment of the two-phase fluid heat transfer structure of the present invention.
Figure 5B:
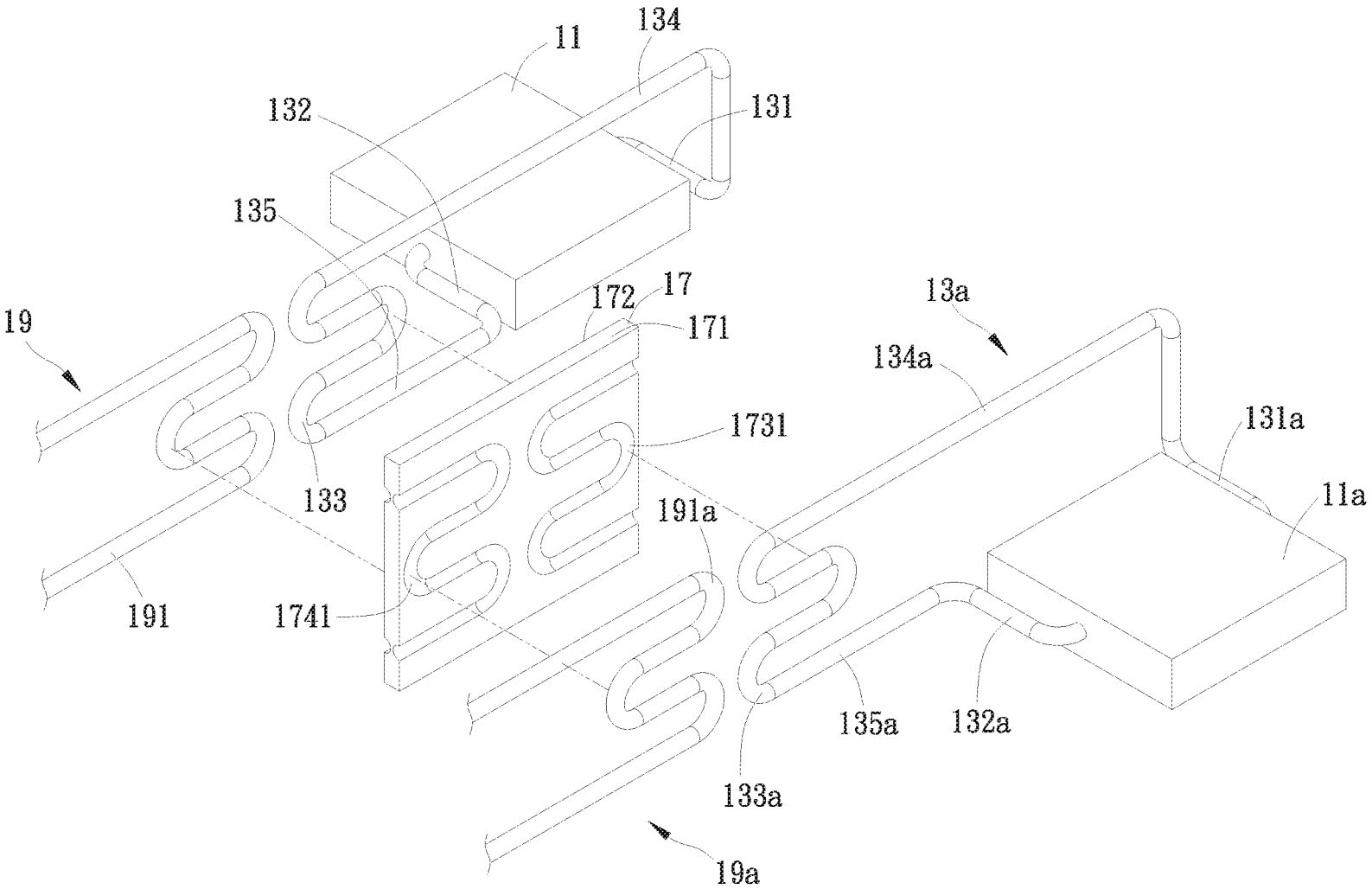
FIG. 5B is a perspective exploded view of the fifth embodiment of the two-phase fluid heat transfer structure of the present invention, seen from another angle.

Please now refer to FIGS. 5A and 5B. FIG. 5A is a perspective exploded view of a fifth embodiment of the two-phase fluid heat transfer structure of the present invention. FIG. 5B is a perspective exploded view of the fifth embodiment of the two-phase fluid heat transfer structure of the present invention, seen from another angle. Also referring to FIGS. 1A and 1B, the fifth embodiment is partially identical to the first embodiment in structure and function and thus will not be redundantly described hereinafter. The fifth embodiment is different from the first embodiment in that the at least one evaporator includes a first evaporator 11 and a second evaporator 11*a*. The at least one evaporator tube body includes a first evaporator tube body 13 and a second evaporator tube body 13*a*. The at least one heat sink tube body includes a first heat sink tube body 19 and a second heat sink tube body 19*a*. The at least one heat sink includes a first heat sink 15 and a second heat sink (not shown). The first and second ends 131, 132 of the first evaporator tube body 13 communicate with the first evaporator 11. The first and second ends 131*a*, 132*a* of the second evaporator tube body 13*a* communicate with the second evaporator 11*a*. The first heat sink tube body 19 is connected to the first heat sink 15. The second heat sink tube body 19*a* is connected to the second heat sink. The structure and assembling relationship of the second heat sink tube body 19*a* and the second heat sink are identical to the structure and assembling relationship of the heat sink tube body 19 and the heat sink 15 as shown in FIG. 1C.

In this embodiment, the first evaporator tube body 13 and the first heat sink tube body 19 are, but not limited to, attached to the first face 171 of the heat exchanger 17. The second evaporator tube body 13*a* and the second heat sink tube body 19*a* are, but not limited to, attached to the second face 172 of the heat exchanger 17. Alternatively, the first evaporator tube body 13 and the first heat sink tube body 19 can be attached to the second face 172 of the heat exchanger 17. The second evaporator tube body 13*a* nd the second heat sink tube body 19*a* can be attached to the first face 171 of the heat exchanger 17. Still alternatively, the first and second evaporator tube bodies 13, 13*a* and the first and second heat sink tube bodies 19, 19*a* can be all attached to the first face 171 or the second face 172.

In this embodiment, the heat exchanger 17 further has a third recess 1731 and a fourth recess 1741. The condensation section 133 of the first evaporator tube body 13 is inlaid in the first recess 1711 and the heat absorption section 191 of the first heat sink tube body 19 is inlaid in the second recess 1721. The condensation section 133*a* of the second evaporator tube body 13*a* is inlaid in the third recess 1731 and the heat absorption section 191*a* of the second heat sink tube body 19*a* is inlaid in the fourth recess 1741.

According to the above arrangement, both the first and second evaporator tube bodies 17, 17*a* heat-exchange with the heat sink 17. The heat exchanger 17 absorbs the heat of the condensation sections 133, 133*a*. The heat absorption sections 191, 191*a* of the first and second heat sink tube bodies 19, 19*a* respectively absorb the heat of the first heat exchanger 17. The second working medium carries away the heat and flows back to the first and second heat sinks. Therefore, the heat exchange area is minified and the heat transfer path is shortened to enhance the heat exchange efficiency.

Figure 6A:
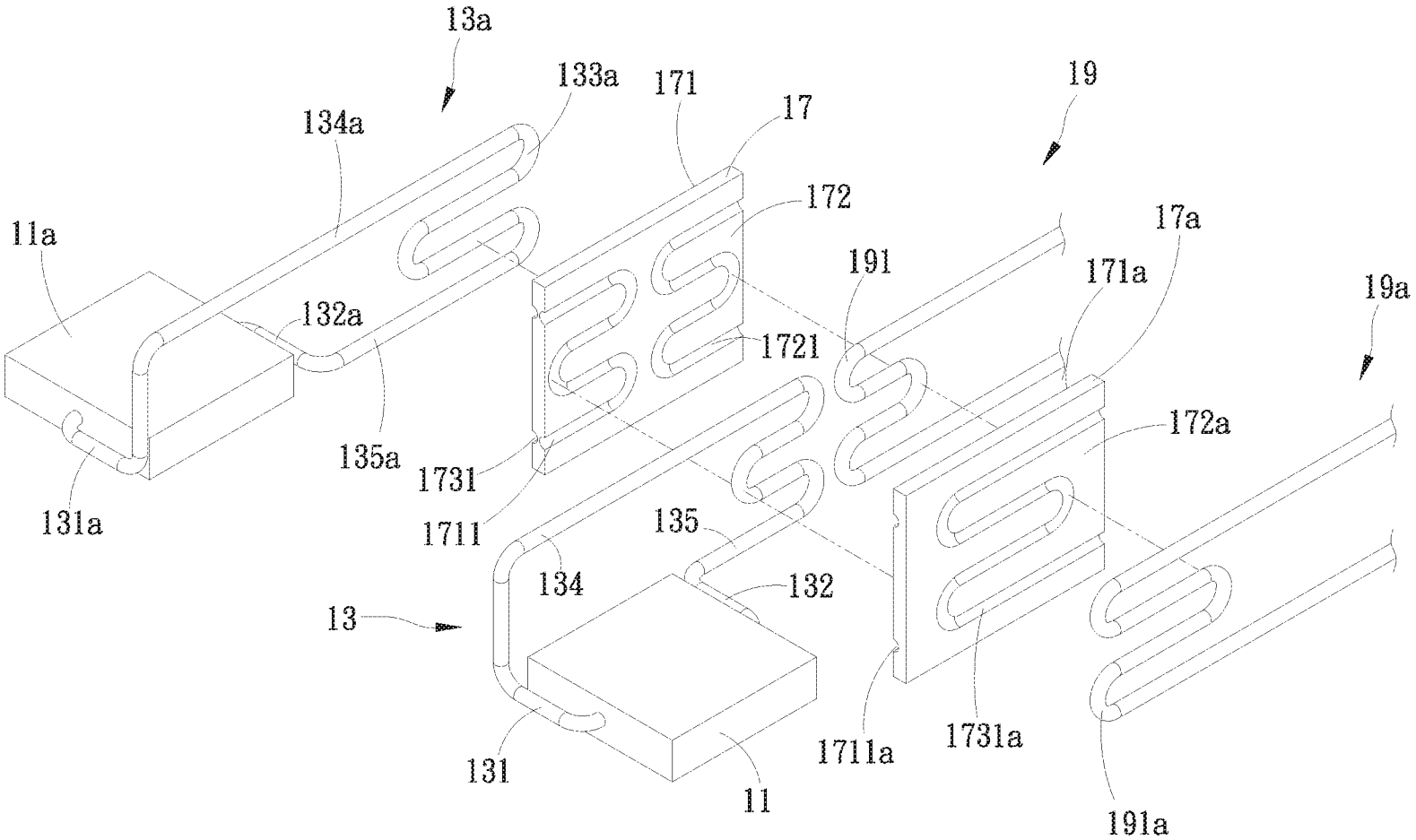
FIG. 6A is a perspective exploded view of a sixth embodiment of the two-phase fluid heat transfer structure of the present invention.
Figure 6B:
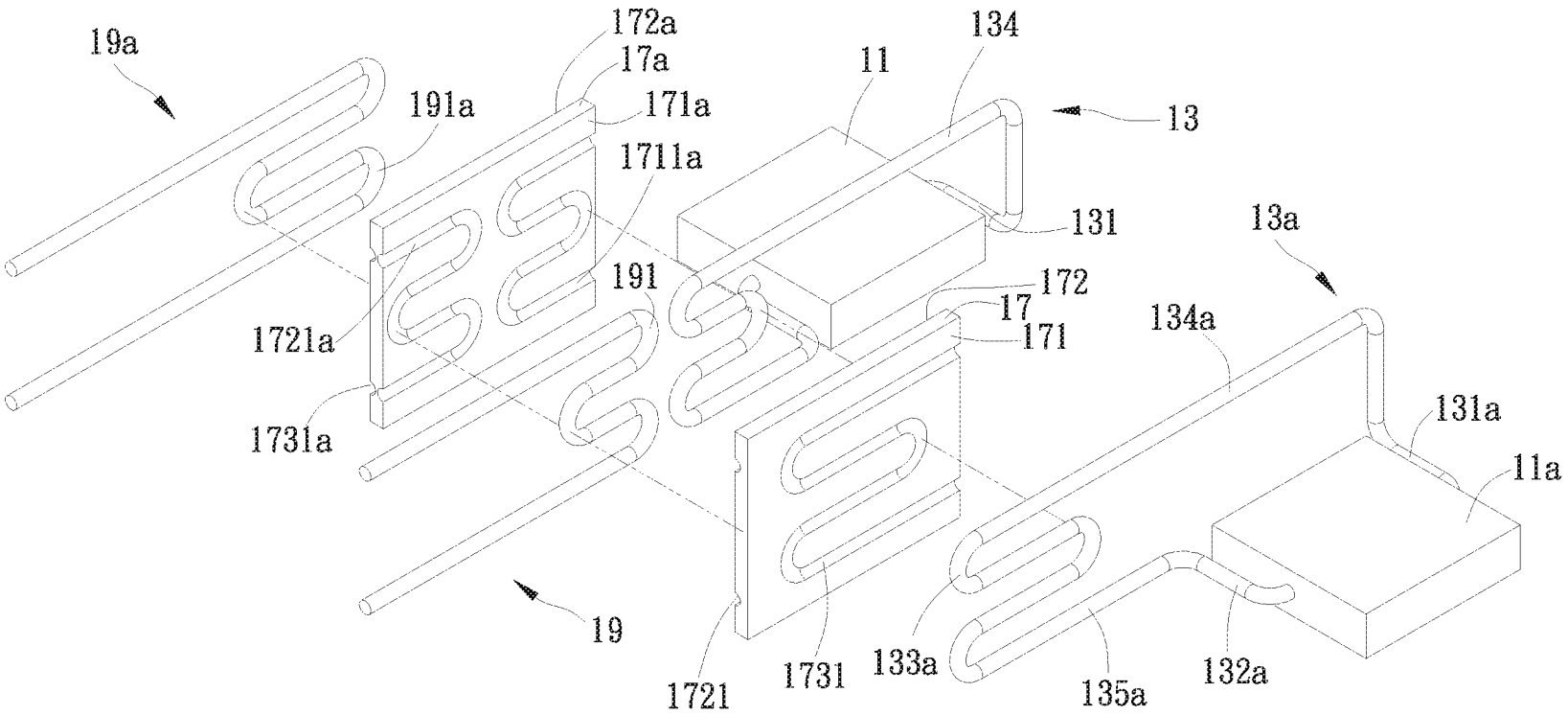
FIG. 6B is a perspective exploded view of the sixth embodiment of the two-phase fluid heat transfer structure of the present invention, seen from another angle.

Please now refer to FIGS. 6A and 6B. FIG. 6A is a perspective exploded view of a sixth embodiment of the two-phase fluid heat transfer structure of the present invention. FIG. 6B is a perspective exploded view of the sixth embodiment of the two-phase fluid heat transfer structure of the present invention, seen from another angle. Also referring to FIGS. 5A and 5B, the sixth embodiment is partially identical to the fifth embodiment in structure and function and thus will not be redundantly described hereinafter. The sixth embodiment is different from the fifth embodiment in that the at least one heat exchanger includes a first heat exchanger 17 and a second heat exchanger 17*a*. The condensation section 133 of the first evaporator tube body 13 and the heat absorption section 191 of the first heat sink tube body 19 and the condensation section 133*a* of the second evaporator tube body 13*a* are attached to the first and second faces 171, 172 of the first heat exchanger 17. The heat absorption section 191*a* of the second heat sink tube body 19*a* is attached to the first and second faces 171*a*, 172*a* of the second heat exchanger 17*a*.

The condensation section 133 of the first evaporator tube body 13 is selectively attached to the first face 171 of the first heat exchanger 17 or the second face 172 of the first heat exchanger 17. The heat absorption section 191 of the first heat sink tube body 19 is selectively attached to the first face 171 of the first heat exchanger 17 or the second face 172 of the first heat exchanger 17. The condensation section 133*a* of the second evaporator tube body 13*a* is selectively attached to the first face 171 of the first heat exchanger 17 or the second face 172 of the first heat exchanger 17. The heat absorption section 191*a* of the second heat sink tube body 19*a* is selectively attached to the first face 171*a* of the second heat exchanger 17*a* or the second face 172*a* of the second heat exchanger 17*a*.

In this embodiment, the first evaporator tube body 13 and the first heat sink tube body 19 are, but not limited to, attached to the first face 171 of the first heat exchanger 17 and the first face 171*a* of the second heat exchanger 17*a*. The second evaporator tube body 13*a* is, but not limited to, attached to the second face 172 of the first heat exchanger 17. The second heat sink tube body 19*a* is, but not limited to, attached to the second face 172*a* of the second heat exchanger 17*a*. Alternatively, the second evaporator tube body 13*a* can be attached to the first face 171 of the first heat exchanger 17 and the first face 171*a* of the second heat exchanger 17*a* and/or the second heat sink tube body 19*a* can be attached to the first face 171 of the first heat exchanger 17 and the first face 171*a* of the second heat exchanger 17*a*.

The first and second heat exchangers 17, 17*a* respectively further have a third recess 1731 and a third recess 1731*a*. The condensation section 133 of the first evaporator tube body 13 is inlaid in the first recess 1711 of the first heat exchanger 17 and the first recess 1711*a* of the second heat exchanger 17*a*. The heat absorption section 191 of the first heat sink tube body 19 is inlaid in the second recess 1721 of the first heat exchanger 17 and the second recess 1721*a* of the second heat exchanger 17*a*. The condensation section 133*a* of the second evaporator tube body 13*a* is inlaid in the third recess 1731 of the first heat exchanger 17. The heat absorption section 191*a* of the second heat sink tube body 19*a* is inlaid in the third recess 1731*a* of the second heat exchanger 17*a*.

Accordingly, the second face 172 of the first heat exchanger 17*a* and the first face 171*a* of the second heat exchanger 17*a* are correspondingly attached to each other.

According to the above arrangement, both the condensation sections 133, 133*a* of the first and second evaporator tube bodies 13, 13*a* heat-exchange with the first heat sink 17. The first heat exchanger 17 absorbs the heat of the condensation sections 133, 133*a* of the first and second evaporator tube bodies 13, 13*a*. The heat absorption section 191 of the first heat sink tube body 19 absorbs the heat of the first heat exchanger 17. The second working medium carries away the heat and flows back to the first heat sink 15. Also, the heat absorption section 191 of the first heat sink tube body 19 heat-exchanges with the second heat exchanger 17*a*. The second heat exchanger 17*a* absorbs the heat of the heat absorption section 191 of the first heat sink tube body 19 and the heat absorption section 191*a* of the second heat sink tube body 19*a* absorbs the heat of the second heat exchanger 17*a*. The second working medium carries away the heat and flows back to the second heat sink. Therefore, the heat exchange area is minified and the heat transfer path is shortened to enhance the heat exchange efficiency.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A two-phase fluid heat transfer structure comprising:

at least one evaporator having an evaporation chamber inside, a first working medium being contained in the evaporation chamber;

at least one evaporator tube body, the evaporator tube body having a first end and a second end, the first and second ends communicating with the at least one evaporator to form a loop of the first working medium, the at least one evaporator tube body further having a condensation section positioned between the first and second ends;

a first heat sink and a second heat sink;

a first heat sink tube body and a second heat sink tube body, each having a heat absorption section, the first and second heat sink tube bodies being connected to the first and second heat sinks, respectively, a second working medium being contained in the first and second heat sink tube bodies; and a first heat exchanger and a second heat exchanger, each having a first face, a second face, a first recess, and a second recess, the first and second faces configured for the condensation section of the at least one evaporator tube body and the heat absorption sections of the heat sink tube bodies to attach to, the condensation section of the at least one evaporator tube body being inlaid in the first recesses of the first and second heat exchangers, the heat absorption section of the first heat sink tube body being inlaid in the second recess of the first heat exchanger, and the heat absorption section of the second heat sink tube body being inlaid in the second recess of the second heat exchanger.

2. The two-phase fluid heat transfer structure as claimed in claim 1, wherein the at least one evaporator tube body further has a vapor section in adjacency to the first end and a liquid section in adjacency to the second end, the condensation section being connected between the vapor section and the liquid section, a capillary structure being disposed in the liquid section.

3. The two-phase fluid heat transfer structure as claimed in claim 1, the first heat sink tube body being connected to the first heat sink, the second heat sink tube body being connected to the second heat sink.

4. The two-phase fluid heat transfer structure as claimed in claim 3, wherein the first face of the first heat exchanger and the first face of the second heat exchanger are correspondingly attached to each other.

5. The two-phase fluid heat transfer structure as claimed in claim 3, wherein the second face of the first heat exchanger and the first face of the second heat exchanger are correspondingly attached to each other.

6. The two-phase fluid heat transfer structure as claimed in claim 1, wherein the at least one heat exchanger is selected from a group consisting of a heat conduction plate, a flat-plate heat pipe, a vapor chamber and a heat conduction base seat.

7. The two-phase fluid heat transfer structure as claimed in claim 1, wherein each of the first and second heat sinks is a radiating fin assembly and each of the first and second heat sink tube bodies is a heat pipe, the first and second heat sinks each being disposed at one end of the respective first and second heat sink tube body distal from the heat absorption section.

8. The two-phase fluid heat transfer structure as claimed in claim 1, wherein each of the first and second heat sinks is a water-cooling radiator having a condensation chamber and a pump, each of the first and second heat sink tube bodies having a third end and a fourth end, the third and fourth ends communicating with the condensation chamber and the pump to form the loop of the second working medium, the heat absorption section being connected between the third and fourth ends.

9. The two-phase fluid heat transfer structure as claimed in claim 4, further comprising a third heat exchanger, a third heat sink tube body, a third heat sink, the third heat sink tube body being connected to the third heat sink, the heat absorption section of the second heat sink tube body being inlaid in the second recess of the second heat exchanger and the first recess of the third heat exchanger, the heat absorption section of the third heat sink tube body being inlaid in the second recess of the third heat exchanger.

10. The two-phase fluid heat transfer structure as claimed in claim 9, wherein the second face of the second heat exchanger and the first face of the third heat exchanger are correspondingly attached to each other.

11. The two-phase fluid heat transfer structure as claimed in claim 5, wherein the at least one heat exchanger further includes a third heat exchanger, the at least one heat sink tube body further including a third heat sink tube body, the at least one heat sink further including a third heat sink, the third heat sink tube body being connected to the third heat sink, the heat absorption section of the second heat sink tube body being inlaid in the second recess of the second heat exchanger and the first recess of the third heat exchanger, the heat absorption section of the third heat sink tube body being inlaid in the second recess of the third heat exchanger.

12. The two-phase fluid heat transfer structure as claimed in claim 11, wherein the second face of the second heat exchanger and the first face of the third heat exchanger are correspondingly attached to each other.

13. The two-phase fluid heat transfer structure of claim 1, wherein the at least one evaporator tube body further has a vapor section in adjacency to the first end and a liquid section in adjacency to the second end, the condensation section being connected between the vapor section and the liquid section.

14. A two-phase fluid heat transfer structure comprising:

a first evaporator and a second evaporator each having an evaporation chamber inside;

a first working medium contained in the evaporation chambers;

a first evaporator tube body and a second evaporator tube body, the first and second evaporator tube bodies each having a first end, a second end, and a condensation section respectively positioned between the first and second ends, the first and second ends of the first evaporator tube body communicating with the first evaporator, the first and second ends of the second evaporator tube body communicating with the second evaporator to form loops of the first working medium;

a first heat sink tube body and a second heat sink tube body each having a heat absorption section;

a first heat sink and a second heat sink, the first heat sink tube body being connected to the first heat sink, the second heat sink tube body being connected to the second heat sink;

a second working medium contained in the first and second heat sink tube bodies; and at least one heat exchanger having a first face, and a second face, the first face and the second face each having a first recess, and a second recess, wherein the first and second faces are configured for the condensation sections of the first and second evaporator tube bodies and the heat absorption sections of the first and second heat sink tube bodies to attach to, the condensation section of the first evaporator tube body being inlaid in the first recess of one of the first and second face, the heat absorption section of the first heat sink tube body being inlaid in the second recess of the one of the first and second face, the condensation section of the second evaporator tube body being inlaid in the first recess of the other of the first and second face, the heat absorption section of the second heat sink tube body being inlaid in the second recess of the other of the first and second face.

15. The two-phase fluid heat transfer structure as claimed in claim 14, wherein the at least one heat exchanger further has a third recess and a fourth recess, the condensation section of the second evaporator tube body being inlaid in the third recess, the heat absorption section of the second heat sink tube body being inlaid in the fourth recess.

16. The two-phase fluid heat transfer structure as claimed in claim 14, wherein the at least one heat exchanger includes a first heat exchanger and a second heat exchanger, each of the first and second heat exchanger having a third recess, the condensation section of the first evaporator tube body and the heat absorption section of the first heat sink tube body and the condensation section of the second evaporator tube body being attached to the first or second faces of the first heat exchanger, the heat absorption section of the second heat sink tube body being attached to the first or second faces of the second heat exchanger, the condensation section of the first evaporator tube body being inlaid in the first recess of the first heat exchanger and the first recess of the second heat exchanger, the heat absorption section of the first heat sink tube body being inlaid in the second recess of the first heat exchanger and the second recess of the second heat exchanger, the condensation section of the second evaporator tube body being inlaid in the third recess of the first heat exchanger, the heat absorption section of the second heat sink tube body being inlaid in the third recess of the second heat exchanger.

17. The two-phase fluid heat transfer structure as claimed in claim 16, wherein the second face of the first heat exchanger and the first face of the second heat exchanger are correspondingly attached to each other.

18. The two-phase fluid heat transfer structure of claim 14, wherein the first and second evaporator tube bodies each further has a vapor section in adjacency to the first end and a liquid section in adjacency to the second end, the condensation section being connected between the vapor section and the liquid section.

19. The two-phase fluid heat transfer structure of claim 14, wherein the first and second evaporator tube bodies each further has a vapor section in adjacency to the first end and a liquid section in adjacency to the second end, the condensation section being connected between the vapor section and the liquid section and wherein a capillary structure is disposed in the liquid section.

* * * * *